United States Patent [19]

Fabbri et al.

[11] Patent Number: 4,486,209

[45] Date of Patent: Dec. 4, 1984

[54] RECOVERING CONDENSABLES FROM A HYDROCARBON GASEOUS STREAM

[75] Inventors: Cesare Fabbri; Gianfranco Bellitto, both of Milan; Giuseppe La Mantia, Cassano D'Adda; Biagio Failla, Milan, all of Italy

[73] Assignee: Snamprogetti, S.p.A., Milan, Italy

[21] Appl. No.: 390,501

[22] Filed: Jun. 21, 1982

[30] Foreign Application Priority Data

Jul. 7, 1981 [IT] Italy ..... 22781 A/81

[51] Int. Cl.[3] ..... F25J 3/02

[52] U.S. Cl. ..... 62/18; 62/28; 62/30; 62/31; 62/34; 62/39

[58] Field of Search ..... 62/9, 11, 12, 13, 18, 62/23, 24, 27, 28, 29, 30, 31, 32, 33, 34, 38, 39, 43, 44

[56] References Cited

U.S. PATENT DOCUMENTS 3,702,541 11/1972 Randall ..... 62/24

4,163,652 8/1979 Gazzi et al. ..... 62/39

4,203,741 5/1980 Bellinger et al. ..... 62/38

*Primary Examiner*—Frank Sever

*Attorney, Agent, or Firm*—Morgan, Finnegan, Pine, Foley & Lee

[57] ABSTRACT

The gaseous mixture to be split is dehydrated and condensed under a high pressure by sending the gases, separated in a first separator (4), to the first stage of an expansion turbine (16) and the condensates are sent to a fractionating column (49), the gases exiting the first stage of the turbine are mixed with the gases exiting a second separator (19), said mixture being sent to a third separator (26) the bottom liquid whereof is sent to the column (49), and the separated gas is mixed with the head gas of the column (49), whereafter it is cooled and sent to a medium-pressure fourth separator (32). The gas coming from the latter separator (32) feeds the second stage of the turbine (16) while the condensate is admixed with the gas discharged from the second stage and sent to an ultimate low-pressure separator (41) wherefrom the condensate is sent to the column (49) head and the residual gas is cooled and compressed (43, 44), the condensates being recovered from the bottom of the column (49).

6 Claims, 1 Drawing Figure

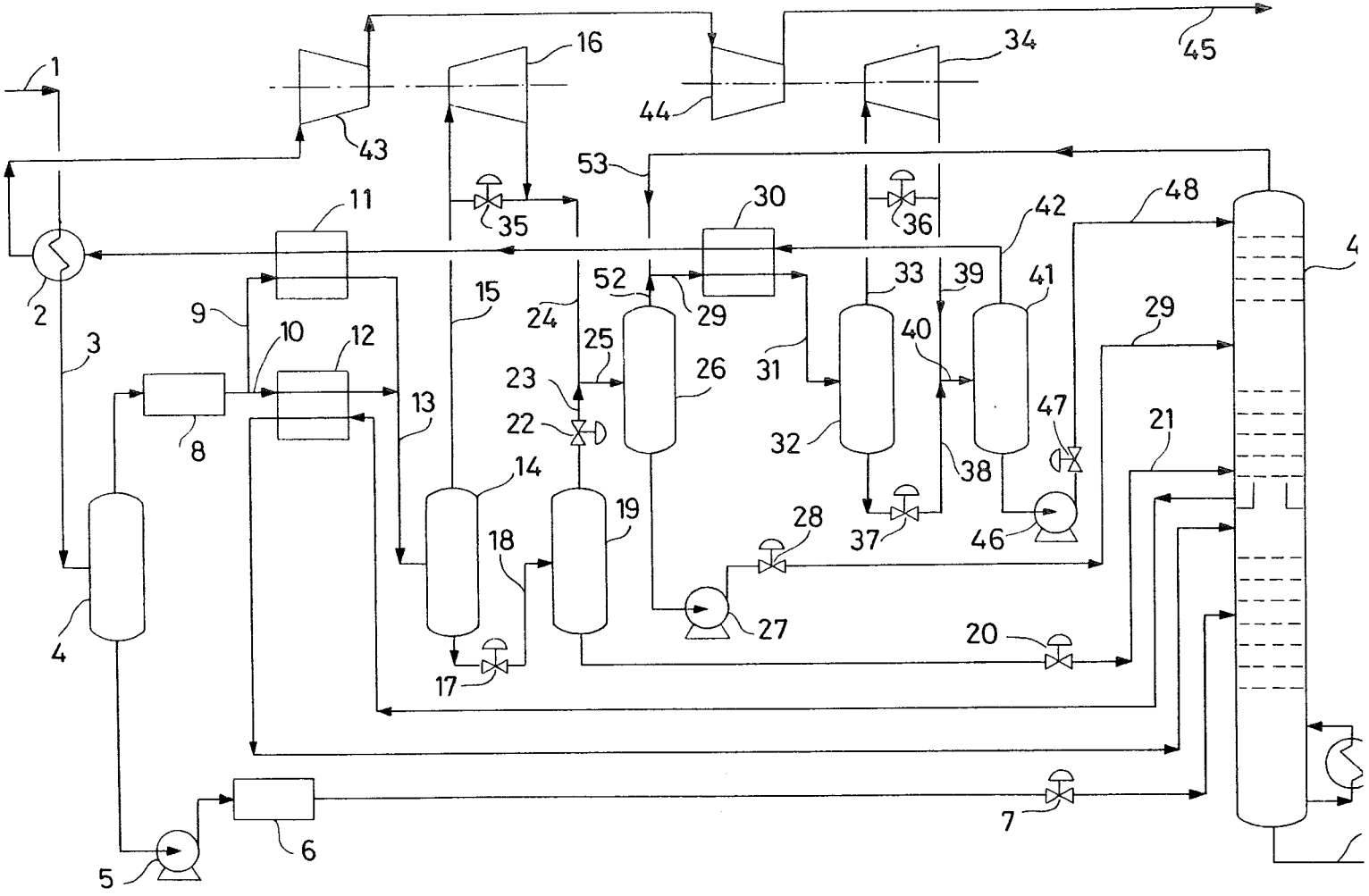
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
48
52
53

RECOVERING CONDENSABLES FROM A HYDROCARBON GASEOUS STREAM

This invention relates to a novel method for recovering condensable hydrocarbons, such as ethane, propane, butanes and higher hydrocarbons from a gaseous stream which contains them.

More particularly, the present method is very efficient and advantageous for recovering ethane, propane and higher members.

A number of methods are already known for recovering condensates from gaseous mixtures, a few of such methods exploiting expansion turbines for obtaining the low temperatures which are required for condensing the gases for the subsequent fractionation of the condensates.

The method according to the present invention differs from the conventional ones in the particular arrangement of the machinery and the different flowsheet, which lead to efficient heat reclaiming and a more efficient fractionation, so that condensable hydrocarbons can be recovered with a minimum power expenditure.

The single FIGURE is a flowsheet of the process for explaining the basic principles of this invention.

The gaseous mixture, which has a comparatively high pressure, enters, via the line 1, a heat exchanger 2, wherein a first cooling step takes place down to temperatures above the temperature at which hydrates are formed (this is a function of the kind of gas and its pressure).

The mixture, then, enters via the line 3 the separator 4 wherein the condensed liquid is separated from the gaseous phase and is pumped by a pump 5 through the solid dehydrating beds 6 and is then fed, through the regulation valve 7, to the lower section of the fractionating column 49. The gas exiting the separator 4 is dehydrated through the solid drying beds 8.

According to a modification of the processing run now outlined, especially when gases having a comparatively low temperature and a light weight (eg. having a high content of methane) the machinery 4, 5, 6 and 7 can be dispensed with and, if so, the gaseous stream can be fed directly to the dehydrating section 8. The dried gas feeds via the lines 9 and 10 the second gas/gas exchanger 11 and the lateral reboiler 12, respectively, wherein it is additionally cooled at the expense of the cool residual gas and of a liquid stream drawn at a certain level of the fractionation column 49, respectively.

The splitting of the rates of flow of the lines 9 and 10 is carried out by appropriate metering devices which are not shown in the flowsheet.

According to a few modifications of the present method, the lateral reboiler 12 can be dispensed with and a few recoveries of negative calories may be effected in the reboiler 50 and/or by providing an external refrigerating source, for example a propane or Freon refrigeration cycle. All this is also a function of the pressure and the composition of the gaseous mixture and of the degree of recovery which is requested.

On cooling the gas at 11 and 12, a partial condensation of hydrocarbons takes place with the attendant formation of a liquid the average composition of which is heavier than that of the vapors in equilibrium. The exiting streams 11 and 12 are combined in the line 13 and feed the high-pressure separator 14, in which the two phases, the liquid and the gaseous ones aforementioned, are separated.

The high-pressure gas feeds through the line 15 the first stage of an expansion turbine 16, wherein the gas is expanded until reaching a pressure intermediate between the feeding pressure and the pressure that the residual gas had prior to having been compressed.

During the expansion of the gas, an isoentropic type conversion is experienced (with a certain efficiency of less than 1) and this is conducive to a considerable cooling of the gas, so that an additional lot of condensates is formed, the result being a further reduction of the content of heavier hydrocarbons in the gas in equilibrium. The work supplied by the expansion turbine can be exploited for a partial compression of the residual gas. The high-pressure liquid emerging from the separator 14 is caused to expand through the expansion valve 17 and is fed via the line 18 to the separator 19 which operates under a pressure which is slightly above the pressure at the turbine (16) outlet. During this expansion of the liquid, which is of a virtually isoenthalpic type, two phases are formed, which are separated at 19, viz. a liquid enriched with the heavier hydrocarbons of the starting liquid, and a gas which is rich with the lighter hydrocarbons.

With this kind of flowsheet one obtains a characteristic feature of the method in question, that is, a preliminary fractionation of the liquid which feeds the fractionation column, so that the efficiency of the recovery of the condensables is obtained, according to the objective of the method in question.

The comparatively cold liquid exiting the separator 19 feeds, through the regulation valve 20 and the line 21, the fractionation column 49 at a level which is immediately above that at which the liquid is withdrawn, which feeds the lateral reboiler 12.

The gas exiting the separator 19 is combined, through the pressure regulation valve 22 and the line 23, with the stream exiting the expansion turbine 16 (line 24).

The mixture, through the line 25, enters the separator 26, in which a liquid is separated, which is comparatively rich with the heavier hydrocarbons and is sent to the fractionation column 49 at a level higher than that of the liquid fed the third as mentioned hereinabove. Feeding is made through the pump 27, the control valve 28 and the line 29. The gas exiting the separator 26 is combined, through the line 52, with the gas coming from the head of the fractionation column 49 (line 53) and feeds, via the line 29, the negative-calorie gas/gas exchanger 30 wherein a further cooling takes place as effected by the residual cold gas coming from the low-pressure separator, the heavier hydrocarbons contained in the gas being further condensed.

Now the mixture enters, via the line 31, the medium-pressure separator 32 wherefrom the gas, after having been stripped of the condensates, feeds, via the line 33, the second stage of the expansion turbine 34 and is expanded down to an appropriate pressure value: this value is comparatively low and is a function of the pressure that the gaseous mixture has at its inlet in the system, of the composition of the mixture concerned, and of the degree of hydrocarbon recovery which is requested from time to time. Also in this case, similarly to what has been described in connection with the first expansion stage (16), a considerable cooling of the gas is obtained and an additional formation of condensates, so that the contents of heavier hydrocarbons in the gas in equilibrium is further reduced.

Again, the work produced by the expansion turbine can be exploited for the partial compression of the residual gas. The expansion turbines, also called turbo-expanders, are available on the market by specialized constructors, who usually provide also the coaxial compressor and appropriate compartments for regulating the flow at the turbine inlet end.

According to a few modifications of the process which has been described up to now, one of the expansion stages might be replaced by an expansion valve (35, 36) and one of the two compressors for the residual gas might be dispensed with.

The liquid coming from the medium-pressure separator 32 is expanded through the valve 37 and is combined, via the line 38, with the stream emerging from the expansion turbine 34 (line 39). The mixture is now fed, via the line 40, to the low-pressure separator 41, wherein a residual gas is separated, which has been stripped of the heavier hydrocarbons to be recovered also. The residual cold gas is heated, through the line 42, in the exchangers 30, 11 and 2 and yields negative calories to the system, whereafter it is compressed by the compressor 43 which is coaxial with the expansion turbine first stage, and by the compressor 44 which is coaxial with the expansion turbine second stage.

The residual gas, which has thus been partially compressed, is fed, via the line 45, to the final compression, if so required, so as to be brought to the pressure indicated for use. The final compressor has not been shown in the flowsheet herein.

A prominent characteristic feature of the method now described is that the liquid emerging fom the separator 32 is not directly fed to the fractionation column 49, but, rather, it is caused to expand to a lower pressure and, moreover, the gas exiting the expansion turbine 34, rather than being fed to the fractionation column 49 together with the condensates, is conversely separated in the separator 41 and fed to the end point of the system as a residual gas.

According to another modification of the process now described, the second stage of the expansion turbine 34 and the compressor 44 can be dispensed with, and the same is true of the machinery 26, 27, 28, 30, 32, 36 and 37, consistently with the pressure and the composition of the gaseous mixture and of the degree of condensate recovery which is required from time to time. If so, the line 25 directly feeds the separator 41 instead of the line 40 and the line 53 is connected to the line 42.

The condensate which is separated in the low-pressure separator 41 is fed, via the pump 46, the regulation valve 47 and the line 48, to the head of the fractionation column 49. The latter has been provided for stripping the lighter hydrocarbons from the several condensate fractions which have been separated during progress of the procedure described hereinabove, said hydrocarbons essentially consisting of methane in the case of recovery of heptane and higher homologs, or a mixture of methane and ethane in the case of recovery of propane and higher members.

The heat which is required for producing the stripping vapours is supplied to the bottom of the reboiler 50 and to an appropriate intermediate stage of the lateral reboiler 12.

According to a further modification of the process, more than one lateral reboiler can be provided so as to recover negative calories in order to cool the gaseous mixture properly.

The heating means for the reboiler 50 can be any heating fluid, such as hot oil, steam, exhaust gases from a gas turbine, or, according to an alternative embodiment of this process, the gaseous mixture itself, or, according to yet another alternative embodiment, the residual gases after the final compression.

The intimate contact between the liquids and the stripping vapours in the interior of the fractionation column 49 is obtained by conventional devices such as valve-plates, foraminous plates or devices of any other kind and packings of any description.

According to a few modifications of the process in question, one or more feeding streams to the fractionation column 49 can be omitted, whereas the feeding stream 48 to the column head is always present.

Yet another characteristic feature of the process described hereinafter is that of admixing the gas produced at the top of the fractionation column 53 with the gas downstream of the first expansion stage (52) and cooling said mixture within the exchanger 30 by exploiting the gas coming from the second expansion stage 34.

The condensate produced at the bottom of the fractionation column 53 can either be cooled or sent to storage, or, also, it can feed a fractionation stage not provided for in the present flowsheet.

A few values of the operative parameters are reported herein by way of example only, without limiting the scope of this invention in the slightest. For example, the pressure of the gaseous mixture at the input line 1 can be between 70 and 40 bars, the gas may contain from 80% to 95% of methane, from 10% to 2% of ethane, from 5% to 2% of propane and from 2% to 0.5% of butanes, the balance of 100% being composed of pentanes and higher homologs, nitrogen and carbon dioxide.

By way of illustration, an example, of eploitation of the principles of the present invention will be reported hereinafter.

The gaseous mixture enters under a pressure of 42 bars and at 35° C. with a composition of 82% methane, 10% ethane, 4% propane, 0.8% isobutane, 1.3% normal-butane, 0.5% isopentane, 0.5% nor.pentane, the balance to 100% consisting of hexane and higher homologs.

The gas is cooled to 25° C. approximately in the exchanger 2 whereafter it is passed to drying with molecular sieves and is split into two streams, viz.: one which is cooled in the heat-exchanger 11 to −75° C. by the action of the residual gas, and the other stream which is cooled to −36° C. by the reboiler 50, and by a propane refrigerating cycle which delivers about one million kilocalories at −20° C., and by a lateral reboiler of the fractionation column 49, all these components being serially connected to each other. The two streams are combined into the line 13 and enter the separator 14 at about −50° C., whereafter the gas is expanded in the turbine 16 until reaching a pressure of about 18 bars and a temperature of −80° C.

The gas exiting the separator 26, after having been combined with the gas emerging from the head of the fractionation column, is cooled down to about −94° C. in the exchanger 30. The gas emerging from the separator 32 is expanded in the turbine 34 down to a pressure of about 9 bars at a temperature of −115° C. The recovery of the ethane, which is a function of the temperature obtained in the low-pressure separator 41, is thus correspondent to the temperature of −115° C. By so doing, the recovery of ethane is about 87.5%, the recovery of propane is about 99.9% and the heavier compounds are virtually entirely recovered.

We claim:

1. A process for recovering condensable hydrocarbons from a gaseous mixed stream which contains them using an expansion means and a fractionating column, comprising the following stages:

(a) cooling (2) said gaseous mixture down to a temperature slightly above the temperature at which a hydrate is formed;

(b) dehydrating (6) the thusly obtained condensates and feeding to a fractionating column (49) only in liquid form;

(c) dehydrating (8) the thusly separated gas and cooling (11) thereof with attendant recovery of negative calories from the residual gas and from a lateral reboiler (12) and the fractionation column (49);

(d) separating (14) the gas from the condensates under a comparatively high pressure and expanding the gas in the first stage of an expansion means (16) down to an intermediate pressure corresponding to the pressure obtained in the head of the fractionation column (49);

(e) expanding said condensates under a comparatively high pressure through an expansion valve (17) down to a pressure which permits the liquid thus obtained to be fed to the fractionation column (49) while the thusly obtained gas (19, 22, 23) is admixed with the stream (24) emerging from the first stage of the expansion means (16);

(f) separating (26) the liquid from the gas of the mixture aforementioned and pumping (27) said liquid (29) to the fractionation column (49);

(g) admixing (52+53) the thusly obtained separated gas with the gas coming from the head of the fractionating column;

(h) cooling (30) the mixed gases of step (g) and recovering negative calories from the residual gas;

(i) separating (32) the gas from the condensates under an immediate pressure and feeding (33) it to the second stage of the expansion means wherein the gas is expanded down to a comparatively low pressure which is a function of the composition and the pressure of the gaseous mixture and of the degree of recovery required;

(j) expanding through a valve (37) the condensates under an intermediate pressure down to the outlet pressure of the expansion means (34) and admixing (38+39) the two streams;

(k) further separating under a low pressure (41) the condensates from the residual gas and feeding the condensates through a pump (46) to the head of the fractionating column (49); and (l) heating the residual gas under a low pressure with recovery of negative calories and recompressing said gas (43);

provided that said fractionating column is fed by multiple inlet lines containing only liquid condensate feed, said condensates all having been separated from gases in separating units (14, 19, 26, 32, 41) upstream of the fractionation column.

2. A process as claimed in claim 3, wherein step (i) comprises: separating the gas from the condensates under an intermediate pressure and expansion through a valve (37) down to a comparatively low pressure.

3. A process as claimed in claim 1, wherein step (c) comprises: dehydrating (8) the separated gas and cooling (11) it while recovering negative calories from the residual gas and from one or more sources of negative calories selected from the group consisting of the reboiler (50) of the fractionation column (49), a lateral reboiler of the said column, a refrigeration cycle, said sources of negative-calories being connected together serially and/or in parallel as a function of the characteristics of the raw gas and of the temperatures which can be attained.

4. A process as claimed in claim 1, wherein steps (i), (j) and (k) are omitted and only a single stage of the expansion means (34) is used.

5. A process as claimed in claim 4, wherein step (c) comprises: dehydrating (8) the separated gas and cooling (11) thereof while recovering negative calories from the residual gas and from one or more sources of negative calories selected from the group consisting of the reboiler (50) of the fractionation column, a lateral reboiler of said column, a refrigeration cycle, said sources of negative calories being connected together in series and/or in parallel as a function of the characteristics of the raw gas and of the temperatures that can be attained.

6. A process as claimed in claim 1, wherein step (i) comprises: separating the gas from the condensates under an intermediate pressure and expansion through a valve (37) down to a comparatively low pressure.

* * * * *